United States Patent [19]

Veillette et al.

[11] 4,374,918

[45] Feb. 22, 1983

[54] THERMALLY STABLE LIQUID NEGATIVE DEVELOPER

[75] Inventors: Norman T. Veillette, Hollis, N.H.; Charles H. C. Pian, Lexington, Mass.; Tahsin A. Ashour, Amherst, N.H.

[73] Assignee: Nashua Corporation, Nashua, N.H.

[21] Appl. No.: 302,504

[22] Filed: Sep. 16, 1981

[51] Int. Cl.[3] ..... G03G 9/12

[52] U.S. Cl. ..... 430/115; 430/112; 430/114; 430/904

[58] Field of Search ..... 430/112, 114, 115, 116, 430/904

[56] References Cited

U.S. PATENT DOCUMENTS

| | | | |
|---|---|---|---|
| 2,891,911 | 6/1959 | Mayer et al. | 430/106 |
| 3,079,272 | 2/1963 | Greig | 430/620 |
| 3,244,633 | 4/1965 | Yellin et al. | 430/115 |
| 3,290,251 | 12/1966 | Nelson | 430/115 |
| 3,507,794 | 4/1970 | Fauser et al. | 430/113 |
| 3,523,906 | 8/1970 | Vrancken et al. | 252/316 |
| 3,523,907 | 8/1970 | Vrancken et al. | 252/316 |
| 3,576,744 | 4/1971 | Sharrock et al. | 430/114 |
| 3,668,126 | 6/1972 | Tamai et al. | 430/137 |
| 3,753,760 | 8/1972 | Kosel | 430/119 |
| 3,776,849 | 12/1973 | Tellier | 430/115 |
| 3,779,924 | 12/1973 | Chechak | 430/137 |
| 3,856,692 | 12/1974 | Mammino et al. | 430/116 |
| 3,856,745 | 12/1974 | Yamaguchi et al. | 260/42.14 |
| 3,869,397 | 3/1975 | Tellier | 430/114 |
| 3,900,412 | 8/1975 | Kosel | 430/114 |
| 3,960,737 | 6/1976 | Kawanishi | 430/114 |
| 3,969,238 | 7/1976 | Tsuneda | 430/114 |
| 3,976,583 | 8/1976 | Herrmann et al. | 430/113 |
| 3,977,983 | 8/1976 | Tsuneda | 430/115 |
| 3,990,980 | 11/1976 | Kosel | 430/113 |
| 3,991,226 | 11/1976 | Kosel | 430/119 |
| 3,997,488 | 12/1976 | Tsubuko et al. | 260/28.5 |
| 3,998,746 | 12/1976 | Tsuneda | 430/114 |
| 4,019,993 | 4/1977 | Tamai et al. | 430/137 |
| 4,040,970 | 8/1977 | Tsuneda | 430/115 |
| 4,104,183 | 8/1978 | Tsubuko et al. | 430/114 |
| 4,156,034 | 5/1979 | Mukoh et al. | 430/106 |
| 4,197,211 | 4/1980 | Amidon et al. | 430/115 |
| 4,243,736 | 1/1981 | Herrmann | 430/115 |
| 4,306,009 | 12/1981 | Veillette et al. | 430/115 |

FOREIGN PATENT DOCUMENTS

| | | |
|---|---|---|
| 1076611 | 7/1967 | United Kingdom . |
| 1135060 | 11/1968 | United Kingdom . |
| 1218064 | 1/1971 | United Kingdom . |
| 2033098 | 5/1980 | United Kingdom . |

*Primary Examiner*—Roland E. Martin, Jr.
*Attorney, Agent, or Firm*—Lahive & Cockfield

[57] ABSTRACT

Disclosed is a thermally stable liquid negative developer comprising an organic liquid carrier, a pigment, a stabilizing gel on the borderline of solubility in the carrier, a latex which imparts a fixative function to the developer, and a two component charge control agent. The charge control agent consists of a first polymer, soluble in the carrier, having a basic character because of the inclusion of pyrrolidone or hydroxylated alkyl groups, and a second polymer, insoluble or on the borderline of solubility in the carrier, having an acid character because of the inclusion of free halogenated groups, and containing a minor amount of carrier soluble moieties. The two components may constitute separate ingredients, or either or both components may be incorporated into the structure of other developer components. Thus, the basic component may be included in the gel, and the acid component included in the latex. The image density of copies produced with the developer remains at optimum levels although the developer is subjected to elevated temperatures in storage or use.

22 Claims, No Drawings

THERMALLY STABLE LIQUID NEGATIVE DEVELOPER

BACKGROUND OF THE INVENTION

This invention relates to electrostatic developer compositions. More particularly, it relates to liquid developer compositions of improved storage and thermal stability.

Conventional liquid negative developers for use in electrostatic copying machines consist of an organic nonpolar liquid carrier having a low dielectric constant and a high resistivity containing a toner comprising a solid particulate resinous fixative and a pigment or pigment system. A charge control agent and one or more substances for enhancing the shelf-life of the composition and for maintaining the various solid components as a homogeneously dispersed phase are also included. When a substrate containing a latent electrostatic image is brought into contact with the developer composition, charged components of the developer are attracted preferentially to the oppositely charged latent image and subsequently fixed, typically by the application of heat to evaporate the carrier, to produce a permanent visible image.

In an ideal developing composition, the fixative and pigment should be intimately associated, of uniform small particle size, and should be uniformly charged. This would result in uniform depletion of the toner as images are developed sequentially and in uniform density of the successively produced copies. In practice, this ideal property of developing compositions has been difficult to achieve. The static charge imparted to the solid particles in such a composition by the charge control agent is typically a function of the chemical properties of the agent and the toner particles and of the surface area of the particles.

Known negative charge agents for liquid developer systems consist of polymers that contain large amounts of electron accepting groups (acid character) such as halogens, e.g., polyvinyl chloride and chlorinated polyethylenes, polypropylenes, or polyisoprenes. These associate with the resinous fixer and pigment components in the developer. In an electric field the charge agent and associated pigment and fixer (latex) take on a net negative charge and migrate to anodic areas of the latent image-bearing substrate.

The use of a separate polymeric component of this type as a charge control agent has an adverse effect on the stability of the developer with respect to changes in temperature in use or storage. More particularly, if the developer is subjected to a temperature substantially above room temperature, the solubility of the charge control agent in the carrier is increased. It has been discovered that this has the effect of allowing the polymer to relax thereby reducing steric hindrance to the uptake of negative charge, with the result that the electronegativity of the developer increases. When such a developer is used the resulting image exhibits a halo effect, that is, the edges of the image taper off to background rather than exhibit a sharp cut-off. Furthermore, upon cooling the developer back down to the temperature at which it is designed to operate, the charge control agent tends to separate itself from other components resulting in a deleterious reduction in homogeneity.

The majority of liquid developer compositions contain vehicle-soluble charge control agents, and since the charge control agent is depleted to a lesser extent than the fixative and pigment, as successive copies are produced the net charge on particles remaining in the developer varies in a complicated way resulting in variations in the image density of the successively produced copies. While this depletion effect can be substantially reduced by employing a carrier insoluble charge control agent such as those disclosed in copending U.S. application, Ser. No. 109,393 filed Jan. 3, 1980, now U.S. Pat. Nos. 4,306,009, and 103,544 filed Dec. 13, 1979, now abandoned, developers using such an approach are nevertheless subject to the thermal instability problem noted above.

SUMMARY OF THE INVENTION

The developer and imaging process of this invention substantially reduce the foregoing problems by virtue of the novel charge control agent composition of a nature hereinafter described. Broadly, the improvements in depletion properties and thermal stability of developers manufactured in accordance with the teachings disclosed herein may be traced to an intimately associated two-component polymeric mixture which serves a charge control function. The two components may constitute separate ingredients, or either or both of the components may be incorporated into the structure of other developer components. The two-component mixture includes a carrier-soluble component comprising moieties of a weakly basic character such as hydroxylated alkyl groups or pyrrolidone, and a carrier insoluble component which comprises some carrier soluble moieties and moieties of an acidic character such as halogen groups, preferably chloride groups. The polymers together form a non-aqueous dispersion which, because of the inclusion of the carrier soluble components, is relaxed in the carrier at storage and use temperatures and is resistant both to temperature change induced losses of homogeneity and to changes in the negative charge carrying properties of the charge control agent.

Broadly, the developer of the invention comprises an organic liquid carrier having a resistivity greater than $10^9$ ohm-cm and a dielectric constant less than 3, a pigment (or pigment system), a stabilizing gel on the borderline of solubility in the carrier, a latex, and a dual component charge control agent comprising a mixture of a first polymer, soluble in the carrier, containing multiple moieties of basic character, and a second polymer, insoluble or on the borderline of solubility in the carrier, containing multiple halogenated moieties of acid character and at least a minor amount of carrier soluble moieties. The first polymer may be added as a separate ingredient, but preferably is designed to have a dispersion stabilizing function, i.e., constitutes a portion of the structure of the gel or a "gelatex" of the type disclosed herein. The second polymer, in addition to its role in providing charge control, preferably constitutes a portion of the structure of the latex, or fixative, component of the developer.

The first polymer making up the charge control agent mix may comprise a major amount of monomer units (A) having the structural formula:

the latex, a latex, and a resinous charge control agent comprising a mixture of two copolymers which have a significant affinity for each other. The two-component charge control agent comprises a mixture of a first polymer, soluble in the carrier, which contains multiple hydroxylated alkyl groups or pyrrolidone groups, and a second polymer, insoluble in the carrier, comprising a minor amount of carrier soluble moieties and multiple groups having moieties of acid character, i.e., halogens.

The carriers useful in the composition of the invention are nonpolar solvents or solvent systems of the type conventionally used in prior art liquid developers. The carrier will have a resistivity greater than about $10^9$ ohm-cm and a dielectric constant less than about 3. As known to those skilled in the art, it will be characterized by an evaporation rate suitable for rapid, e.g., two second, evaporations from the substrate to be developed when exposed to temperatures below which paper is charred. It will preferably be free of aromatic liquids and other excessively toxic or corrosive components. Also, as is known, it should have a viscosity low enough to permit rapid migration of particles which are attracted to the electrostatically charged image to be developed. Typically, the viscosity of the vehicle may range between about 0.5 and 2.5 centipoise at room temperature.

Nonlimiting examples of suitable carriers include petroleum fractions which are substantially odorless, relatively inexpensive, and commercially available such as those sold by Humble Oil and Refining Company under the trademarks ISOPAR G, ISOPAR H, ISOPAR K, and ISOPAR L. These materials comprise various mixtures of about $C_8$–$C_{16}$ hydrocarbons.

The pigment or pigment system employed in the composition of the invention is also conventional. The preferred method of imparting color to the toner particles is to use a fine solid particulate pigment in combination with one or more dyes which associate with the composition's resinous components. Carbon black particles in the submicron range are preferred, but powdered metals and metal oxides may also be used. Various dyes of recognized utility in imparting color to vinyl resins may be used in combination with the particulate pigment. The presently preferred pigment system for use in the composition of the invention comprises Printex 140u, a carbon black sold by Degussa Inc. having a mean particle size of 0.029 microns, plus alkali blue (BASF Wyandotte), monarch green (Herculese Inc.), and cromophtal red (Ciba-Giegy).

A polymeric gel which stabilizes the developer dispersion is also included therein. The gel is designed to be both compatible with the vinyl components of the latex and to be on the borderline of solubility-insolubility in the organic nonpolar carrier. It comprises, as an essential component, a polymer or a copolymer containing a major amount of monomer units selected from the group consisting of $C_8$–$C_{20}$ esters of acrylic or methacrylic acid. This developer component has a molecular weight in the range of $10^3$ to about $10^6$ and swells when mixed with non-polar organic carriers of the type described above. Such $C_8$–$C_{20}$ alkyl esters may be homopolymerized or copolymerized with each other or various other vinyl type monomers. Nonlimiting examples of suitable comonomers include vehicle insoluble monomers such as lower alkyl esters of acrylic and methacrylic acids, provided that the ratio of the monomers is low enough such that solvation of the resulting copolymer in the vehicle is assured. Other useful compounds include glycidyl methacrylate or acrylate, crotonic, maleic, atropic, fumaric, itaconic, and citraconic acids, acrylic, methacrylic, and maleic, anhydrides, acrylonitrile, methacrylonitrile, acrylamide, hydroxy ethyl methacrylate and acrylate, hydroxy propyl methacrylate and acrylate, dimethyl amino methyl methacrylate and acrylate, allyl alcohol, cinnamic acid, methallyl alcohol, propargyl alcohol, and mono and dimethyl maleate and fumarate.

Suitable methods of synthesizing gels of the type described above for use in the developer system of the invention are set forth below.

PREPARATION OF SOLUBLE MULTIPOLYMER GEL PRECURSORS

A. 800 g of lauryl methacrylate and 3.54 g of benzoyl peroxide are added to 1.3 liters of Isopar G in a 5 liter flask where the temperature is maintained between 80° and 95° and allowed to react for 6 hours under a nitrogen atmosphere to form a lauryl methacrylate homopolymer. The overall reaction concentration is about 40%, and about a 95% conversion to the polymer is achieved.

B. The procedure of A is repeated except that 40 g of glycidyl methacrylate is included in the reaction flask and a 20:1 poly (lauryl-glycidyl) methacrylate copolymer is produced. Less than about 10% of the originally added monomers remain unreacted.

C. The procedure of B is repeated. Next, 40 g of methacrylic acid and 0.54 g hydroquinone are added to the polymer solution and the solution is maintained at about 93° C. for 12–15 hours to form a small amount of hydroquinone-methacrylic acid complex.

D. The procedure of C is repeated except that 20 g of acrylic acid are substituted for the 40 grams of methacrylic acid. A 20:1 poly (lauryl-glycidyl) methacrylate copolymer and a complex of hydroquinone and acrylic acid are produced. Polymer yield is on the order of 90+%.

E. The procedure of C is repeated except that 10 g of crotonic acid are substituted for the 40 grams of methacrylic acid. A 20:1 poly (lauryl-glycidyl) methacrylate copolymer and a complex of hydroquinone and crotonic acid are produced. Polymer yield is on the order of 90+%.

F. The procedure of C is repeated except that 20 g of methacrylic acid is substituted for the 40 grams of methacrylic acid. A 20:1 poly (lauryl-glycidyl) methacrylate copolymer and a complex of hydroquinone and methacrylic acid are produced.

GEL PREPARATION

G. 40 g of methacrylic acid and 0.5 g of hydroquinone are added to 1 liter of Isopar G and maintained at about 90° C. for about 10 hours. Next, 40 grams of lauryl methacrylate, 18 g methyl methacrylate, and 0.5 g benzoyl peroxide are added to the reaction flask to initiate polymerization. Polymerization is continued for five hours to produce a methacrylic acid-lauryl methacrylate-methyl methacrylate terpolymer. The terpolymer solution/dispersion is added to about 100 grams of soluble precursor A and ball milled to produce a substantially homogeneous gel on the borderline of solubility in Isopar G.

H. The procedure of G is repeated except that 100 g of soluble precursor B is substituted for precursor A. After ball milling for 10 hours, a substantially homogeneous gel on the borderline of solubility in Isopar G is produced.

I. 102 g (dry weight) of soluble precursor C is mixed with 18 g methyl methacrylate, 0.3 g benzoyl peroxide, and 900 ml of Isopar G and reacted in a 2 liter flask under a nitrogen atmosphere for 5 hours. A gel is formed which is on the borderline of solubility in Isopar G at room temperature. Substantially no free monomer can be detected in the reaction flask.

J. The procedure of I is repeated except that 100 g of precursor D is substituted for precursor C. A gel similar in properties to that described in section I is produced.

K. The procedure of I is repeated except that 100 g of precursor E is substituted for precursor C. A gel similar in properties to that described in section I is produced.

L. 84 g (dry weight) of a precursor similar to precursor C, except that only 10 grams of methacrylic acid are added after polymerization of the lauryl-glycidyl copolymer, are added to 36 grams methyl methacrylate and 0.3 g benzoyl peroxide in 900 ml Isopar G. The mix is maintained under a nitrogen atmosphere for 5 hours at a temperature of less than 80° C. A viscous gel is produced, and less than about 4% unreacted polymer can be found in the reaction flask.

M. 90 g (dry weight) of precursor F are added to 30 g methyl methacrylate and 0.3 g benzoyl peroxide in 900 ml Isopar G. The mix is maintained under a nitrogen atmosphere for 5 hours at a temperature of less than about 80° C. A viscous, but less gelled polymer is produced with about 93% conversion.

When using a gel of the type set forth above, the charge control agent components are synthesized separately in a two-stage polymerization. Preferably, the first polymer (basic character) is synthesized first, and the second polymer (acid character) which also serves as the latex component is thereafter synthesized in the presence of the first. The two component charge control agent mixtures may be produced as follows:

A carrier-soluble polymer containing plural weakly basic moieties, preferably in the range of 0.5% to about 2.5% by weight, is prepared from the following ingredients in, e.g., Isopar G.

1. A major amount of monomer having the formula:

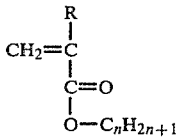

where R is H or $CH_3$ and n is 8–20 (carrier-soluble moiety)

2. A minor amount of monomer having the formula:

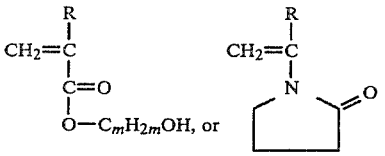

where R is H or $CH_3$ and m may be 1–20 but is preferably 2 or 3 (basic moiety)

3. A minor amount of cross-linker having the formula:

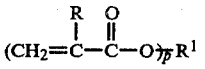

where R is H or $CH_3$, P is 2 or 3, and $R^1$ is a carbon chain having 2–20 carbon atoms and may contain aromatic rings or oxygen containing moieties.

4. A minor amount of a monomer having the formula:

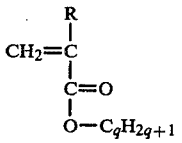

where R is H or $CH_3$ and q is 3–6 (monomer of reaction rate intermediate 1 and 2) and 5. a free-radical initiator catalyst such as benzoyl peroxide, azobis isobutyronitrile, etc.

After formation of this polymer, which is soluble (preferably) or on the borderline of solubility in the carrier (depending on relative quantities of 1 vs. 2, 3, and 4 employed), the second polymer (carrier-insoluble or partially insoluble component) is prepared, preferably in the same reaction flask, from the following ingredients.

6. A minor amount of monomer 1 and monomers 3 or 4 or both (set forth above) to provide carrier-soluble moieties.

7. A minor amount of a monomer having the formula:

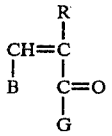

where R is H or $CH_3$, G is chloride or bromide, and B is H, alkyl, or Halogenated alkyl having 1–6 carbon atoms, phenyl, lower alkyl substituted phenyl, or acyl halide, or monomer 7 may consist of a halogenated monomer such as chlorostyrene or 3-chloro-1-butene.

8. A major amount of a monomer having the formula:

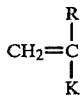

where R is H or $CH_3$ and K is $—COOC_LH_{2L+1}$ (L=1–6),

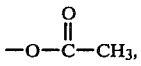

or phenyl.

9. a catalyst such as set forth in No. 5 above.

Ingredient 6 imparts partial solubility in the carrier. Ingredients 3 and 4 have reaction rates intermediate that of ingredients 1, 7 and 8 and promote complete polymerization.

This component contained multiple moieties of acid character (halogens), preferably chlorides, in about 0.5% to 4.0% by weight. Monomeric acids such as carboxylic, sulfonic, etc., form weak and unacceptably charged non-aqueous dispersions and should be avoided.

Specific examples of suitable charge control agent are set forth below:

EXAMPLES OF PREPARATION OF TWO-COMPONENT CHARGE CONTROL PREPARATION

The following ingredients are added to 5 liter flasks equipped with thermometers, stirrers, reflux condensers, and an $N_2$ inlet to prepare the carrier soluble basic character component.

| | |
|---|---|
| | I-a |
| 200 g | Lauryl methacrylate (LMA) |
| 24 g | Hydroxypropyl methacrylate (HPMA) |
| 2 g | Ethylene glycol dimethacrylate (EGDMA) |
| 760 g | Isopar G, and |
| 1.0 g | Benzoyl peroxide (BP) |
| | II-a |
| 200 g | LMA |
| 22 g | Hydroxyethyl methacrylate |
| 10 g | Butyl methacrylate (BMA) |
| 1.0 g | Azobis isobutyronitrile (AIBN) |
| 440 g | Isopar G |
| | III-a |
| 200 g | LMA |
| 24 g | HPMA |
| 2.0 g | EGDMA |
| 1.0 g | BP |
| 760 g | Isopar G |
| | IV-a |
| 200 g | LMA |
| 11 g | HPMA |
| 2.0 g | EGDMA |
| 1.0 g | BP |
| 600 g | Isopar G |
| | V-a |
| 200 g | LMA |
| 11 g | HPMA |
| 2.0 g | EDGMA |
| 1.0 g | BP |
| 600 g | Isopar G |
| | VI-a |
| 200 g | LMA |
| 24 g | HPMA |
| 2.0 g | EGDMA |
| 1.0 g | BP |
| 600 g | Isopar G |

Each of the reaction mixtures are heated to 90° C. while purging with $N_2$ for about 4 hours. The contents of the flasks are then cooled and the acid character component, which also serves as a latex, is prepared by adding to the respective flasks:

| | |
|---|---|
| | I-b |
| 1540 g | Isopar G |
| 430 g | Methyl methacrylate (MMA) |
| 40 g | LMA |
| 20 g | BMA |
| 26 g | Acryloyl Chloride (ACl) |
| 1.8 g | Azobis isobutyronitrile (AIBN) |
| | II-b |
| 1360 g | Isopar G |
| 430 g | MMA |
| 40 g | LMA |
| 20 g | BMA |
| 26 g | ACl |
| 1.8 g | AIBN |

-continued

| | |
|---|---|
| | III-b |
| 1450 g | Isopar G |
| 216 g | MMA |
| 20 g | LMA |
| 10 g | BMA |
| 12 g | Methacryloyl chloride (MACl) |
| 1.0 g | BP |
| | IV-b |
| 1540 g | Isopar G |
| 430 g | Styrene Monomer (SM) |
| 40 g | LMA |
| 20 g | BMA |
| 22 g | Cinnamoyl Chloride (CCl) |
| 1.8 g | AIBN |
| | V-b |
| 1540 g | Isopar G |
| 380 g | Vinyl Acetate (VA) |
| 40 g | 2-ethyl hexyl acrylate (EHA) |
| 26 g | Crotonyl Chloride |
| 1.8 g | AIBN |
| | VI-b |
| 1540 g | Isopar G |
| 380 g | VA |
| 40 g | EHA |
| 20 g | Fumaryl Chloride |
| 1.8 g | AIBN |

Each of the reaction flasks is heated to about 70° C. while purging with nitrogen for 4 hours. The product is an opaque white non-aqueous dispersion containing the following weight percent solids (approximate):

| I | II | III | IV | V | VI |
|---|---|---|---|---|---|
| 22 | 27 | 16 | 18 | 16 | 18 |

In place of or in addition to stabilizing gels of the type set forth above, the developer of the invention may include a gelatex of the type set forth in copending application Ser. No. 109,393. The gelatex comprises a mixture of polymers which act as a fixitive and dispersant. It consists of a carrier-insoluble vinyl polymeric latex and a multiply branched vinyl polymeric gel framework which physically entraps or entangles the carrier insoluble polymer and is itself slightly soluble or on the borderline of solubility in the carrier. If the multiply branched component of the gelatex is synthesized to include a minor amount of moieties of basic character such as pyrrolidone or hydroxylated alkyl, it serves the dual roles of stabilizing the developer and providing the basic component of the charge control agent. When using such a gelatex (basic polymer constituent included), the polymer of acidic character is separately synthesized and then blended with the gelatex. Alternatively, the insoluble latex component of the gelatex may be synthesized to include halogenated groups, in which case no separate acidic polymer need be added.

Methods of making a gelatex wherein a basic component (vinly pyrrolidone) is included in the structure are set forth below.

MULTIPOLYMER PREPARATION

Multipolymers at about 40% solids are prepared by copolymerizing the monovinyl monomers and crosslinkers listed in Tables 1, 2, and 3. The reactions are conducted using azobis isobutyronitrile or benzoyl peroxide (as indicated) in Isopar G under a nitrogen atmosphere for about six hours after reaching 80° C. The data set forth are given in parts by weight unless otherwise specified. The reaction products are translucent solutions which exhibit the Tyndall effect, indicating that the gel is on the borderline of solubility.

TABLE I

| Ingredient | Multipolymer Number 1 | 2 | 3 | 4 | 5 | 6 | 7 | 8 |
|---|---|---|---|---|---|---|---|---|
| Lauryl-meth-acrylate | 672.75 | 673 | 673.25 | 673.5 | 688.25 | 688.5 | 697.75 | 698 |
| Vinyl-Pyrroli-done | 75 | 75 | 75 | 75 | 60 | 60 | 50 | 50 |
| Ethylene-dimeth-acrylate | 2.25 | 2 | 1.75 | 1.5 | 1.75 | 1.5 | 2.25 | 2 |
| Acrylic Acid | | | | | | | | |
| Dioctyl-maleate | | | | | | | | |
| Dimethyl amino-ethylmeth-acrylate | | | | | | | | |
| AIBN[1] | 3.75 | 3.75 | 3.75 | 3.75 | 3.75 | 3.75 | 3.75 | 3.75 |
| % polymer recovery | 95.5 | 92.5 | 92.7 | 94.3 | 95.1 | 93.7 | 94.5 | 95.2 |
| Reaction conc. (%) | 40 | 40 | 40 | 40 | 40 | 40 | 40 | 40 |

[1]Azobis isobutyronitrile

TABLE II

| Ingredient | Multipolymer Number 9 | 10 | 11 | 12 | 13 | 14 | 15 | 16 |
|---|---|---|---|---|---|---|---|---|
| Lauryl-meth-acrylate | 698.25 | 698.5 | 695 | 696 | 697 | 696 | 697 | 696 |
| Vinyl-Pyrroli-done | 50 | 50 | 50 | 50 | 50 | 50 | 50 | 50 |
| Ethylene-dimeth-acrylate | 1.75 | 1.5 | 2 | 2 | 2 | 2 | 2 | 2 |
| Acrylic Acid | | | 3 | 2 | 1 | 2 | 1 | 3 |
| Dioctyl-maleate | | | | | | | | |
| Dimethyl amino-ethylmeth-acrylate | | | | | | | | |
| AIBN[1] | 3.75 | 3.75 | 4.25 | 4 | 3.75 | 3.75 | 4.25 | 3.75 |
| % polymer recovery | 94.5 | 94.7 | 93.9 | 91.2 | 90.4 | 89.1 | 92.4 | 92.2 |
| Reaction conc. (%) | 40 | 40 | 40 | 40 | 40 | 40 | 40 | 40 |

[1]Azobis isobutyronitrile

TABLE III

| Ingredient | Multipolymer Number 17 | 18 | 19 | 20 | 21 | 22 |
|---|---|---|---|---|---|---|
| Lauryl-meth-acrylate | 705 | 706 | 696 | 707.5 | 710 | 275 |
| Vinyl-Pyrroli-done | 40 | 40 | 40 | 37.5 | 35 | 20 |
| Ethylene-dimeth-acrylate | 5 | 2 | 2 | 5 | 5 | 0.6 |
| Acrylic Acid | | 2 | 2 | | | |
| Dioctyl-maleate | | | 10 | | | |
| Dimethyl-amino-ethylmeth-acrylate | | | | | 4 | |
| AIBN[1] | 3.75 | 4 | 4 | 3.75 | 3.75 | 1.5 |

TABLE III-continued

| Ingredient | Multipolymer Number 17 | 18 | 19 | 20 | 21 | 22 |
|---|---|---|---|---|---|---|
| % polymer recovery | 90.3 | 92.0 | 92.5 | 90.3 | 91.3 | 86.8 |
| Reaction conc. (%) | 40 | 40 | 40 | 40 | 40 | 40 |

[1]Azobis isobutyronitrile

GELATEX PRODUCTION

The gel polymers dispersed in isopar produced as set forth above are used as a reaction medium to conduct a latex polymerization. The amount and identity of the various monomers used and other data pertinent to the reaction are set forth below. These reactions are conducted in about 580 g Isopar G under a nitrogen atmosphere for about five hours after the reaction medium reaches 80° C. The product form described as a "VIS GLT" is preferred. Data are given in parts by weight unless otherwise specified. The resulting gelatex compositions comprise an opaque, viscous latex.

TABLE IV

| Ingredient | Gelatex Number 1 | 2 | 3 | 4 | 5 | 6 | 7 | 8 |
|---|---|---|---|---|---|---|---|---|
| multipolymer used from example | 1 | 2 | 3 | 4 | 5 | 6 | 7 | 8 |
| multipolymer conc. (% solids) | 38.5 | 37.4 | 37.5 | 38.0 | 38.25 | 38.5 | 38.1 | 38.4 |
| multipolymer used (wet) | 165 | 283.4 | 282 | 278 | 277 | 303 | 306 | 276 |
| (dry) | 63.5 | 106 | 106 | 105.7 | 106 | 116.6 | 116.6 | 106 |
| Methyl methacrylate | 54 | 90 | 90 | 90 | 90 | 99 | 99 | 90 |
| Methacrylic acid | 2.4 | 4 | 4 | 4 | 4 | 4.4 | 4.4 | 4 |
| Ethylene di-methacrylate | | | | | | | | |
| Cellolyn[3] | | | | | | | | |
| Wax | | | | | | | | |
| AIBN[1] | 0.35 | 0.75 | 0.75 | 0.75 | | | | |
| $B_2O_2$[2] | | | | | 0.5 | 0.55 | 0.55 | 0.5 |
| % recovery | | 94.1 | 95.3 | 97.2 | | 97.8 | 88.0 | 97.8 |
| Reaction Conc. (%) | 15 | 30 | 30 | 30 | 30 | 30 | 30 | 30 |

TABLE IV-continued

| Ingredient | Gelatex Number 1 | 2 | 3 | 4 | 5 | 6 | 7 | 8 |
|---|---|---|---|---|---|---|---|---|
| Form[4] | GEL | VIS GLT | VIS GLT | VIS GLT | GEL | VIS GLT | VIS GLT | VIS GLT |

[1]Azobis Isobutyronitrile
[2]Benzolyl peroxide
[3]hydroxylated wood rosin
[4]GEL = formation of gel - little turbidity
VIS GLT = more viscous, turbid, preferred gelatex compositions

TABLE V

| Ingredient | Gelatex Number 9 | 10 | 11 | 12 | 13 | 14 | 15 | 16 |
|---|---|---|---|---|---|---|---|---|
| multipolymer used from example | 9 | 10 | 11 | 12 | 13 | 14 | 15 | 16 |
| multipolymer conc. (% solids) | 38.1 | 38.2 | 37.8 | 37.6 | 37.35 | 36.9 | 37.7 | 37.2 |
| multipolymer used (wet) | 278 | 278 | 841 | 423 | 851.4 | 288 | 844 | 301 |
| (dry) | 106 | 106 | 317.9 | 159 | 318 | 106.2 | 318.1 | 112 |
| Methyl methacrylate | 90 | 90 | 270 | 135 | 270 | 90 | 270 | 80 |
| Methacrylic acid | 4 | 4 | 12 | 6 | 12 | 4 | 12 | 8 |
| Ethylene dimethacrylate | | | | | | | | |
| Cellolyn[3] | | | | | | | | |
| Wax | | | | | | | | |
| AIBN[1] | | 0.7 | | | | | | |
| $B_2O_2$[2] | 0.6 | | 1.41 | 0.7 | 1.5 | 0.47 | 1.41 | 0.43 |
| % recovery | 94.6 | 93.7 | 100.0 | 93.8 | 100.0 | | 100.0 | 99.3 |
| Reaction Conc. (%) | 30 | 30 | 30 | 18.8 | 30 | 30 | 25 | 30 |
| Form[4] | VIS GLT | VIS GLT | VIS GLT | VIS GLT | VIS GLT | VIS GLT | VIS GLT | VIS GLT |

[1]Azobis Isobutyronitrile
[2]Benzolyl peroxide
[3]hydroxylated wood rosin
[4]GEL = formation of gel - little turbidity
VIS GLT = more viscous, turbid, preferred gelatex compositions

TABLE VI

| Ingredient | Gelatex Number 16B | 17 | 18 | 19 | 20 | 21 | 22 |
|---|---|---|---|---|---|---|---|
| multipolymer used from example | 16B | 17 | 18 | 19 | 20 | 21 | 22 |
| multipolymer conc. (% solids) | 37.2 | 37.3 | 37.7 | 37.2 | 37.4 | 37.2 | 35 |
| multipolymer used (wet) | 298 | 284 | 281.2 | 341.9 | 284 | 285 | 191 |
| (dry) | 110.8 | 105.9 | 106 | 127.2 | 106.2 | 106 | 66.85 |
| Methyl methacrylate | 80 | 90 | 90 | 108 | 90 | 90 | 57 |
| Methacrylic acid | 8 | 4 | 4 | 4.8 | 4 | 4 | 2.5 |
| Ethylene dimethacrylate | 0.5 | | | | | | |
| Cellolyn[3] | | | | | | | 23 |
| Wax | | | | | | | 23 |
| AIBN[1] | | | | | | | 0.5 |
| $B_2O_2$[2] | 0.43 | 0.47 | 0.5 | 0.5 | 0.47 | 0.47 | |
| % recovery | 98.2 | | 99.7 | 99.8 | | 88.6 | 86.1 |
| Reaction Conc. (%) | 30 | 20 | 25 | 25 | 30 | 22 | 22 |
| Form[4] | VIS GLT | GEL | VIS GLT | VIS GLT | GEL | VIS GLT | GEL |

[1]Azobis Isobutyronitrile
[2]Benzolyl peroxide
[3]Hydroxylated Wood Rosin - (Herculese)
[4]GEL = formation of gel - little turbidity
VIS GLT = more viscous, turbid, preferred gelatex compositions As a result of these reactions there are produced turbid (opaque) gelatex compositions comprising highly branched and cross-linked, vinyl pyrrolidone containing copolymer gels which act as a matrix for carrier-insoluble linear (or branched in the case of example 16B) latex polymers. The molecular weights of the polymers vary widely between about $10^3$ to about $10^5$, with the soluble component on average in the $10^4$–$10^5$ molecular weight range.

If a gelatex of the type set forth above is used in place of the gel, then material prepared as described below may be used as the second polymer of acidic character. (Alternatively, materials I–VI (set forth above), but omitting basic components I-a through VI-a may be used.) To produce the acidic component for use in gelatex-type compositions, chlorine containing polymers e.g., polyvinyl chloride (homopolymers or multipolymers), polychloroprene, or chlorinated polyethylene, polypropylene, polyisoprene, etc., are grafted with a monomer or a combination of monomers of the type;

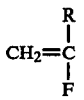

where R is H or $CH_3$, F is $COOC_nH_{n+1}$ where n is 1–20, preferably 4–12, —$OCOCH_3$, or phenyl. The chlorine containing monomer units preferably constitute 50–95% of the second component, most preferably 70–90%. This component is insoluble or partially soluble in the carrier. It may be prepared as follows

EXAMPLE A

To a 5 l flask equipped with a thermometer, stirrer, reflux condenser, and $N_2$ inlet is added:

| | |
|---|---|
| 433 g | Toluene |
| 740 g | chlorinated poly (isoprene) (Parlon S-5, Hercules, Inc.) |

The polyisoprene is dissolved with heat (to ≈60° C.) if necessary. Thereafter, the following materials are added to the flask:

| | |
|---|---|
| 260 g | Lauryl Methacrylate (LMA) |
| 4.0 g | Benzoyl Peroxide (BP) |

The reaction mixture is heated to 85° C. while purging with $N_2$. The temperature is maintained at 85° C. for 4 hours, during which time the color of the reaction mixture changes from dark brown to golden yellow. Next, 520 g Toluene are added with vigorous stirring, followed by slow addition of 1600 g of a gelatex (≈25% solids).

The toluene is then removed by vacuum and heat (≈100° C.), and the liquid content is made up with Isopar G.

| | |
|---|---|
| Final Product | 2064 g |
| solids | 60.6% |
| acid character polymer | 41.3% |
| gelatex | 19.3% |

EXAMPLE B

The procedure of example A is repeated, except that the 260 g LMA is replaced with 87 g of LMA and 44 g of butyl methacrylate (BMA).

EXAMPLE C

To a 5 l flask equipped with a thermometer, stirrer, reflux condenser, and $N_2$ inlet is added:

| | |
|---|---|
| 583 g | Toluene |
| 675 g | Parlon 10P (chlorinated polypropylene from Hercules, Inc.) |

The polypropylene is dissolved with heat (to ≈60° C.) if necessary. Thereafter, the following materials are added to the flask:

| | |
|---|---|
| 135 g | Butyl acrylate (BA) |
| 4.5 g | BP |

The reaction mixture is then heated to 85° C. while purging with $N_2$. The temperature is maintained at 85° C. for 4 hours, during which time the color of the reaction mixture changes from dark brown to golden yellow. Next, 975 g of toluene are added with vigorous stirring, followed by slow addition of 1125 g of a gelatex (25% solids).

The toluene is then removed by vacuum and heat (≈100° C.), and the liquid content is made up with Isopar G.

| | |
|---|---|
| Final product | 2188 g |
| solids | 44.4% |
| acid character polymer | 31.6% |
| gelatex | 12.8% |

EXAMPLE D

To a 5 l flask equipped with a thermometer, stirrer, reflux condenser and $N_2$ inlet is added:

| | |
|---|---|
| 530 g | Cyclohexanone |
| 490 g | Geon 652 (vinylidene chloride/vinyl chloride from B. F. Goodrich Chem. Co. supplied as a latex which is dried in a vac oven at 80° C.) |

The chlorinated copolymer is dissolved with heat (≈60° C.) if necessary. Thereafter the following materials are added to the flask:

| | |
|---|---|
| 189 g | BA |
| 4.2 g | BP |

The reaction mixture is then heated to 85° C. while purging with $N_2$. The temperature is maintained at 85° C. for 4 hours, during which time the color of the reaction mixture changes from dark brown to golden yellow. Next, 564 g methylethyl ketone (MEK) are added with virorous stirring, followed by slow addition of 1050 g of a gelatex (25% solids) and 518 g of Isop H.

The MEK and cyclohexanone are then removed with vacuum and heat (≈100° C.), and the liquid content is made up with Isopar G.

| | |
|---|---|
| Final product | 1975 g |
| solids | 41% |
| acid character polymer | 27.7% |
| gelatex | 13.3% |

Developer concentrates having improved storage and thermal stability capable of producing upwards of 10,000 copies of uniform image density may be produced from the foregoing ingredients by adding to Isopar G the following ingredients so that a dispersion containing 20–25% by weight solids is produced.

| Ingredient | Parts by Weight |
|---|---|
| Pigment[1] | 40–60 |
| Two-component charge control (I–VI) (component I-b to VI-b serve as latex) | 50–70 |
| Gel G, H, I, J, K, L, or M | 40–70 |
| Wood rosin[2] | 15–25 |
| Wax[3] | 15–25 |

A preferred composition consists of, as parts by weight solids:

| Ingredient | Parts by Weight |
|---|---|
| Pigment[1] | 50 |
| Two-component charge control (I–VI) | 60 |
| Gel G, H, I, H, K, L, or M | 50 |
| Wood rosin[2] | 20 |
| Wax[3] | 20 |

[1]36 parts printex 140u, 8 parts monarch green, 4 parts alkali blue, 2 parts cromophtal red.
[2]Cellolyn 21 (Herculese).
[3]FT-150 (purified parrafin).

The ingredients are blended by ball milling for 20 hours in Isopar G (20% solids).

A developer embodying the invention using gelatex may be prepared by ball milling the following ingredients (parts by weight) in Isopar G (20% solids) for 20 hours.

| Ingredient | Parts by Weight |
|---|---|
| Pigment[1] | 40–60 |
| Gelatex (1–22) | 60–100 |
| Acid Character Polymer[2] | 20–40 |
| Wood Rosin[3] | 10–30 |
| Wax[4] | 10–30 |

Preferred developers of this type consist of the following ingredients in the following parts by weight:

| | Parts by Weight | |
|---|---|---|
| Ingredient | A | B |
| Pigment[1] | 50 | 50 |
| Gelatex (2) | 85 | 72 |
| Acid Character Polymer[2] | 25 | 38 |
| Wood Rosin[3] | 20 | 20 |
| Wax[4] | 20 | 20 |

[1]36 parts printex 140u (carbon black), 8 parts monarch green, 4 parts alkali blue, 2 parts cromophtal red.
[2]Poly LMA — chloroisoprene produced as disclosed in Example A.[3]Cellolyn 21
[4]FT-150 (purified parrafin).

Developers made as set forth above have been subjected to standard testing procedures in an effort to assess their storage and thermal stability.

Centrifuge tests are performed by adding 80 ml. of developer concentrate to centrifuge tubes and subjecting the tubes to high gravity in a centrifuge apparatus. This simulates the long term settling properties of the developer normally experienced in the field. Rating of results are as follows 1. Sedimentation—This is the amount of material that will settle to the bottom of the container. The numerical ratings refer to the percent settled with 0, indicating no settling, and 5, indicating 100% settling.

2. Consistency—this is a subjective rating of the softness or hardness of the material that settles during the centrifuge testing. 1 refers to a very soft cake and 5 refers to a very hard cake.

3. Redispersibility—This is a subjective rating of the redispersibility of the sediment. A rating of 1 indicates that simple hand shaking of the centrifuge tube will completely redisperse the sediment while a rating of 5 indicates that the sediment is hard packed and will not redisperse.

The lower the ratings in each of these categories, the more stable the developer in storage.

Set forth below are the results of centrifuge tests performed on the developers of this invention and commercially available liquid negative developers.

| | Centrifuge Evaluation | | |
|---|---|---|---|
| | Sedimentation | Consistency | Redispersibility |
| Prior Art Developers | 3–5 | 2–5 | 3–5 |
| Developers Disclosed herein | 1–2 | 1–2 | 1–3 |

The cyclic temperature test is performed by subjecting the developer to cyclic temperature variations of room temperature to 125° F. and then evaluating the change in viscosity of the developers over time. This simulates the aging properties of the developer experienced during shipping and warehousing. A decrease from its initial viscosity indicates that the developer is not well stabilized and that precipitation or flocculation of solids is occurring. A substantial (greater than 10 cps) increase in viscosity indicates that the developer is gelling and will cause problems in use. A continued increase in viscosity will render the developer unfit for its intended use.

In the chart below, initial viscosity is the viscosity obtained before testing. Oven viscosity is the viscosity obtained after repeated heating and cooling (cooled to room temperature before reading), and aged viscosity is the viscosity obtained after an additional 24 hours. In the ideal developer, all three measurements would be identical.

Set forth below are the results of cyclic temperature tests performed on the developers of this invention and commercially available liquid negative developers.

| | Cyclic Temperature Evaluation | | |
|---|---|---|---|
| | Initial Vis. | Oven Vis. | Aged Vis. |
| Prior Art Developers | 16 | 30 | 80 |
| Developers Disclosed Herein | 15 | 20 | 20 |

Other embodiments are within the following claims.

What is claimed is:

1. A liquid negative developer composition of improved storage and thermal stability for developing an electrostatic latent image on the surface of an image bearing member, said composition comprising:

an organic liquid carrier having a resistivity greater than $10^9$ ohm-cm and a dielectric constant less than 3;

a pigment;

a gel on the borderline of solubility in said carrier;

a latex which is insoluble in said carrier, and a two-component charge control agent for imparting a negative charge to said composition consisting essentially of a first polymer, soluble in said carrier, containing multiple moieties of basic character and comprising a major amount of monomer units (A) selected from the group consisting of:

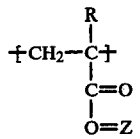

and a minor amount of monomer units (B) selected from the group consisting of:

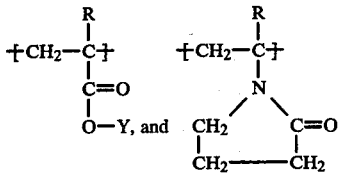

wherein R. is $CH_3$ or H, Z is a hydrocarbon chain having 8–20 carbon atoms, and Y is a hydroxylated alkyl group; and a second polymer, insoluble in said carrier, containing multiple halogen moities of acid character and a minor amount of carrier-soluble moities.

2. The developer of claim 1 wherein said first polymer comprises said gel.

3. The developer of claim 2 wherein said gel comprises a multiply branched, covalently crosslinked structure which entraps said latex, said gel and latex together constituting a gelatex.

4. The developer of claim 1 wherein said second polymer includes a major amount of carrier-insoluble moieties and comprises said latex.

5. The developer of claim 4 wherein said first polymer comprises a major amount of lauryl methacrylate monomer units and a minor amount of hydroxypropyl methacrylate monomer units.

6. The developer of claim 4 wherein said monomer units (A) and (B) are cross-linked.

7. The developer of claim 4 wherein, of the total weight solids in said composition, between about 0.1% and 5.0% comprise monomer units B.

8. The developer of claim 4 wherein, of the total weight solids in said composition, between 0.3% and 1.2% comprise monomer units B.

9. The developer of claim 4 wherein said second polymer comprises a minor amount of carrier-soluble monomer units (C) selected from the group consisting of:

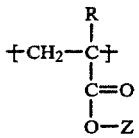

a minor amount of monomer units (D) for imparting acidic properties to the polymer selected from the group consisting of halogenated dienes having 3–4 carbon atoms and halogenated vinyl compounds; and a major amount of carrier-insoluble monomer units (E) selected from the group consisting of:

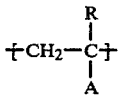

wherein R is H or $CH_3$, Z is a hydrocarbon chain having 8–20 carbon atoms, and A is selected from the group consisting of:

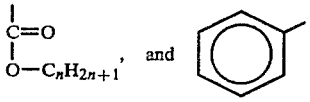

wherein n is 1–6.

10. The developer of claim 9 wherein said halogenated vinyl compounds are selected from the group consisting of:

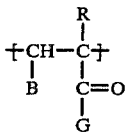

wherein G is chloride, R is H or $CH_3$, and B is H, alkyl having 1–6 carbon atoms, halogenated alkyl having 1–6 carbon atoms, phenyl, lower alkyl ($C_1$–$C_3$)substituted phenyl, or acyl halide.

11. The developer of claim 9 wherein said halogenated vinyl compounds are selected from the group consisting of acryloyl chloride, methacryloyl cloride, cinnamoyl chloride, crotonyl chloride, fumaryl chloride, and mixtures thereof.

12. The developer of claim 9 wherein said monomer units (D) are chlorinated isoprene.

13. The developer of claim 9 wherein said monomer unit E is selected from the group consisting of methyl methacrylate, butyl methacrylate, and mixtures thereof.

14. The developer of claim 9 wherein, of the total weight solids in said composition, between about 0.6% and 1.3% comprise monomer units D.

15. The developer of claim 9 consisting essentially of the following ingredients in the following parts by weight dispersed in said carrier:

| Ingredient | Parts by Weight |
|---|---|
| pigment | 40–60 |
| first and second polymers (charge control agent) | 50–70 |
| gel | 40–70 |
| wood rosin | 15–25 |
| wax | 15–25 |

16. The developer of claim 9 consisting essentially of the following ingredients in the following parts by weight dispersed in said carrier:

| Ingredient | Parts by Weight |
|---|---|
| pigment | 50 |
| first and second (charge control agent) | 60 |
| gel | 50 |
| wood rosin | 20 |
| wax | 20 |

17. The developer of claim 3 wherein said second polymer comprises halogenated dienes having 3–4 carbon atoms.

18. The developer of claim 17 wherein said halogenated dienes are selected from the group consisting of chlorinated polyisoprene, chlorinated polypropylene, and vinylidene chloride.

19. The developer of claim 17 consisting essentially of the following ingredients in the following parts by weight dispersed in said carrier:

| Ingredient | Parts by Weight |
|---|---|
| pigment | 40–60 |
| Gelatex (basic character) | 60–100 |
| Second polymer (acid character) | 20–40 |
| wood rosin | 10–30 |
| wax | 10–30 |

20. The developer of claim 17 consisting essentially of the following ingredients in the following parts by weight dispersed in said carrier:

| Ingredient | Parts by Weight |
|---|---|
| pigment | 50 |
| Gelatex (basic character) | 72 |
| Second Polymer (acid character) | 38 |
| wood rosin | 20 |
| wax | 20 |

21. The developer of claim 17 wherein, of the total weight solids in said composition, between about 1.4% to 3.2% comprises monomer units selected from the group consisting of vinyl compounds containing hydroxylated alkyl groups and pyrrolidone, and between about 5% to 21% comprises monomer units consisting of halogenated dienes having 3–4 carbon atoms.

22. The developer of claim 17 consisting essentially of the following ingredients in the following parts by weight dispersed in said carrier:

| Ingredient | Parts by Weight |
|---|---|
| pigment | 50 |
| Gelatex (basic character) | 85 |

-continued

| Ingredient | Parts by Weight |
|---|---|
| Second Polymer (acid character) | 25 |
| wood rosin | 20 |
| wax | 20 |

* * * * *